US010697666B2

(12) United States Patent
Beneke et al.

(10) Patent No.: US 10,697,666 B2
(45) Date of Patent: Jun. 30, 2020

(54) ONE PIECE ROLL-FORMED DAMPER FRAME AND METHOD OF MANUFACTURE

(71) Applicant: Air Distribution Technologies IP, LLC., Milwaukee, WI (US)

(72) Inventors: Jeffrey S. Beneke, Peculiar, MO (US); Kent S. Maune, Independence, MO (US)

(73) Assignee: Air Distribution Technologies IP, LLC, Milwaukee, WI (US)

( * ) Notice: Subject to any disclaimer, the term of this patent is extended or adjusted under 35 U.S.C. 154(b) by 237 days.

(21) Appl. No.: 15/815,951

(22) Filed: Nov. 17, 2017

(65) Prior Publication Data

US 2018/0087802 A1 Mar. 29, 2018

Related U.S. Application Data

(63) Continuation of application No. 14/065,320, filed on Oct. 28, 2013, now abandoned.

(51) Int. Cl.

| | |
|---|---|
| ***F24F 13/20*** | (2006.01) |
| ***B21D 5/08*** | (2006.01) |
| ***B21D 53/74*** | (2006.01) |
| ***F24F 13/02*** | (2006.01) |
| ***F24F 13/10*** | (2006.01) |

(52) U.S. Cl.

CPC ..... *F24F 13/20* (2013.01); *B21D 5/08* (2013.01); *B21D 53/74* (2013.01); *F24F 13/02* (2013.01); *F24F 13/0245* (2013.01); *F24F 13/10* (2013.01); *Y10T 29/49945* (2015.01)

(58) Field of Classification Search

CPC ..... F24F 13/0245; B21D 53/74; B21D 5/16
USPC ..... 72/379.2; 52/658
See application file for complete search history.

(56) References Cited

U.S. PATENT DOCUMENTS

| | | | | |
|---|---|---|---|---|
| 2,219,594 A | | 10/1940 | Lang | |
| 2,241,266 A | | 5/1941 | Mayne et al. | |
| 2,952,342 A | | 9/1960 | Schnittker | |
| 3,327,766 A | * | 6/1967 | Kurz | E06B 3/96 160/381 |
| 3,348,353 A | | 10/1967 | Cartagena | |
| 3,718,081 A | * | 2/1973 | Root | F24F 13/15 454/335 |
| 3,768,223 A | | 10/1973 | Kurz | |
| 3,788,223 A | * | 1/1974 | Schaefer | F42B 3/10 102/332 |
| 3,854,248 A | | 12/1974 | Dayus | |
| 4,254,541 A | | 3/1981 | St. John | |
| 4,269,255 A | | 5/1981 | Nailor et al. | |

(Continued)

*Primary Examiner* — Gregory D Swiatocha
(74) *Attorney, Agent, or Firm* — Fletcher Yoder, P.C.

(57) ABSTRACT

A single piece roll-formed frame comprising a first channel having a base section and one or more legs, each leg comprising an upper side extending from the base section at a first angle and a lower side extending from the upper side at a second angle, a second channel having a base section and one or more legs, each leg comprising an upper side extending from the base section at the first angle and a lower side extending from the upper side at the second angle and wherein the base section of the first channel and the base section of the second channel are formed from a single piece and intersect to form a third angle, and the upper side of each leg of the first channel overlaps the upper side of each leg of the second channel.

21 Claims, 4 Drawing Sheets

(56) References Cited

U.S. PATENT DOCUMENTS

| | | | | |
|---|---|---|---|---|
| 4,446,667 | A * | 5/1984 | Hertel | F24F 13/00<br>52/658 |
| 5,618,092 | A | 4/1997 | Doud et al. | |
| 5,755,069 | A | 5/1998 | Sullivan | |
| 2003/0229980 | A1 | 12/2003 | LaSusa | |

* cited by examiner

ONE PIECE ROLL-FORMED DAMPER FRAME AND METHOD OF MANUFACTURE

This is a continuation of U.S. patent application Ser. No. 14/065,320, filed Oct. 28, 2013, and entitled "One Piece Roll-Formed Damper Frame and Method of Manufacture," the entirety of which is incorporated by reference for all purposes.

TECHNICAL FIELD

The present disclosure relates to ventilation components, and more specifically to a one piece roll-formed damper frame and method of manufacture.

BACKGROUND OF THE INVENTION

Frames can be manufactured from separate roll-formed components, but these frames can suffer from a number of problems, such as noise, rattle, looseness, leakage and other problems.

SUMMARY OF THE INVENTION

A single piece roll-formed frame is disclosed that includes a first channel having a base section and one or more legs, each leg comprising an upper side extending from the base section at a first angle and a lower side extending from the upper side at a second angle. The single piece roll-formed frame also has a second channel having a base section and one or more legs, each leg comprising an upper side extending from the base section at the first angle and a lower side extending from the upper side at the second angle. The base section of the first channel and the base section of the second channel are formed from a single piece and intersect to form a third angle, and the upper side of each leg of the first channel overlaps the upper side of each leg of the second channel.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE SEVERAL VIEWS OF THE DRAWINGS

Aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views, and in which.

DETAILED DESCRIPTION OF THE INVENTION

Figure 1:
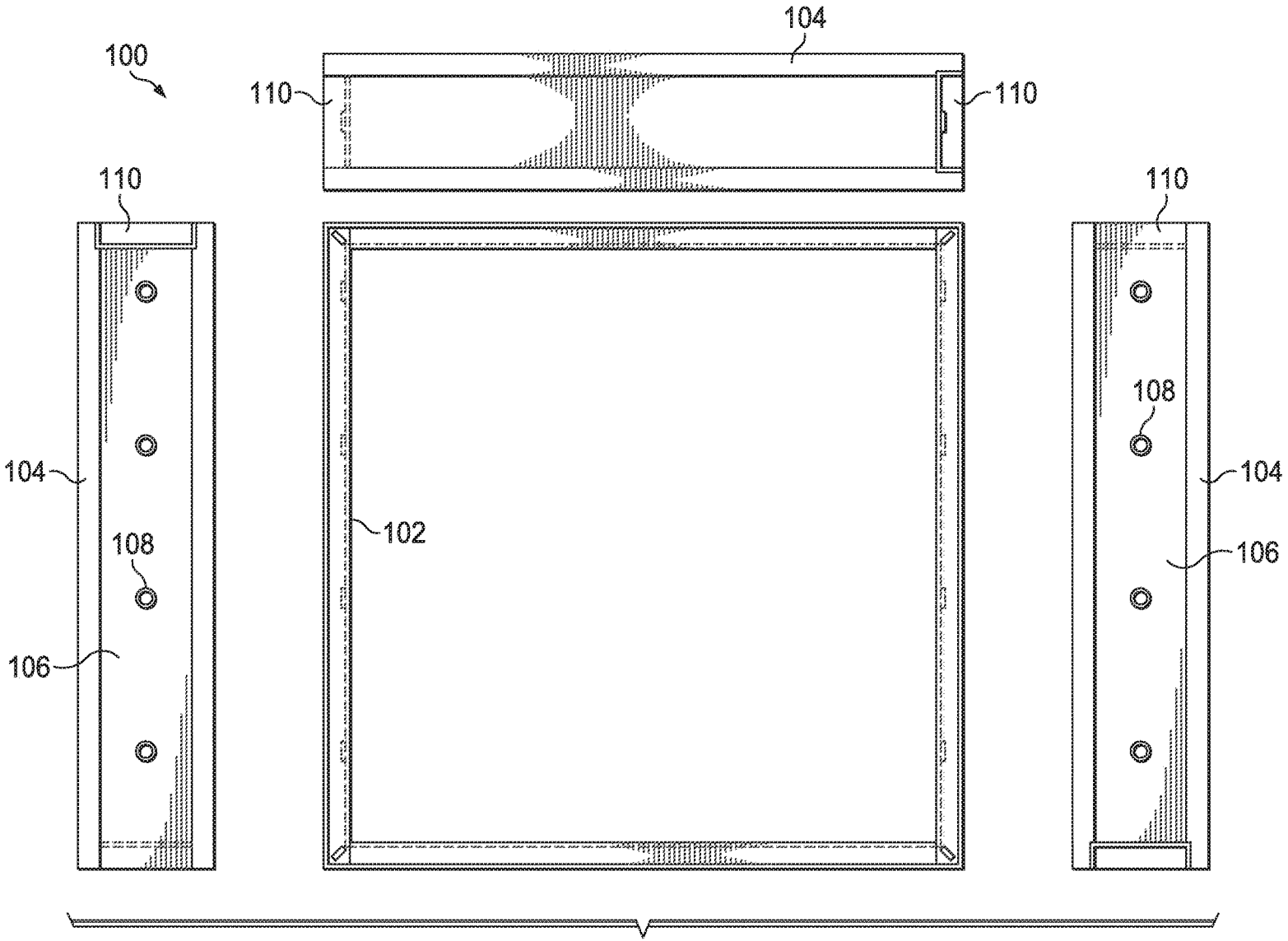
FIG. 1 is a diagram of a single piece roll-formed frame in accordance with an exemplary embodiment of the present disclosure.

In the description that follows, like parts are marked throughout the specification and drawings with the same reference numerals. The drawing figures might not be to scale and certain components can be shown in generalized or schematic form and identified by commercial designations in the interest of clarity and conciseness.

This invention relates to air handling devices, and more particularly to a one piece frame construction for dampers, louvers or other suitable items, and a method of manufacturing the one piece frame.

Air handling devices are commonly utilized in buildings and other structures to control the flow of air, smoke or other gases through a particular section of the building. For example, building codes often specify that dampers that are used in air handling systems should be used in ductwork to prevent the spread of smoke and combustion air through the air handing system ductwork in the event of fire. Dampers can also or alternatively be used for temperature control, to control air flow, to control an amount of ventilation for a particular structure, or for other suitable purposes.

The construction of air handling system components must be durable to ensure that the air handling system remains operable without the need for frequent repair or replacement. Such components may need to be installed in locations that are not easy to access, and they may be exposed to harsh environmental conditions, such as extreme cold or heat.

There are a number of other constraints on such air handling system components, such as the need to keep the cost of manufacturing low, which is addressed by manufacturing such components from sheet steel that is roll formed. While one piece roll-formed frames are known, the present disclosure provides for transverse slots in the channel shaped longitudinal frame member, to allow the frame sections to be bent to define a frame opening and flanges integral with the channel, which are un-severed to provide continuous integrity throughout the frame perimeter. Tabs formed in the frame web material by extensions of the transverse slots overlap the proximal frame section across the web and are used to provide a caulking edge to seal the damper frame from leakage to the atmosphere. The overlapping material in the corners is secured by means of a rectangular clinch to hold the damper frame square.

FIG. 1 is a diagram, of a single piece roll-formed frame 100 in accordance with an exemplary embodiment of the present disclosure. Single piece roll-formed frame 100 includes frame assembly 102, which has four sides. The material used to form single piece roll-formed frame 100 can be metal sheet, metal strip, polymer sheet, polymer strip or other suitable materials.

Two opposing sides of the four-sided frame shown in FIG. 1 include four punched holes 108 forming extruded bearing surfaces, and the other two opposing sides do not include any punched holes (other suitable numbers of holes or attachment features can also or alternatively be provided). Likewise, holes, slots or other features can also or alternatively be formed in the adjacent sides, the holes can be formed by drilling, etching, burning or in other suitable manners, or other processes can also or alternatively be used. The sides of single piece roll-formed frame 100 include base section 106 and leg assemblies 104, which form, a hat channel cross section or other suitable cross-sections. In addition, tabs 110 are provided at each corner to facilitate sealing single piece roll-formed frame 100 with caulk, to prevent leakage.

Figure 2:
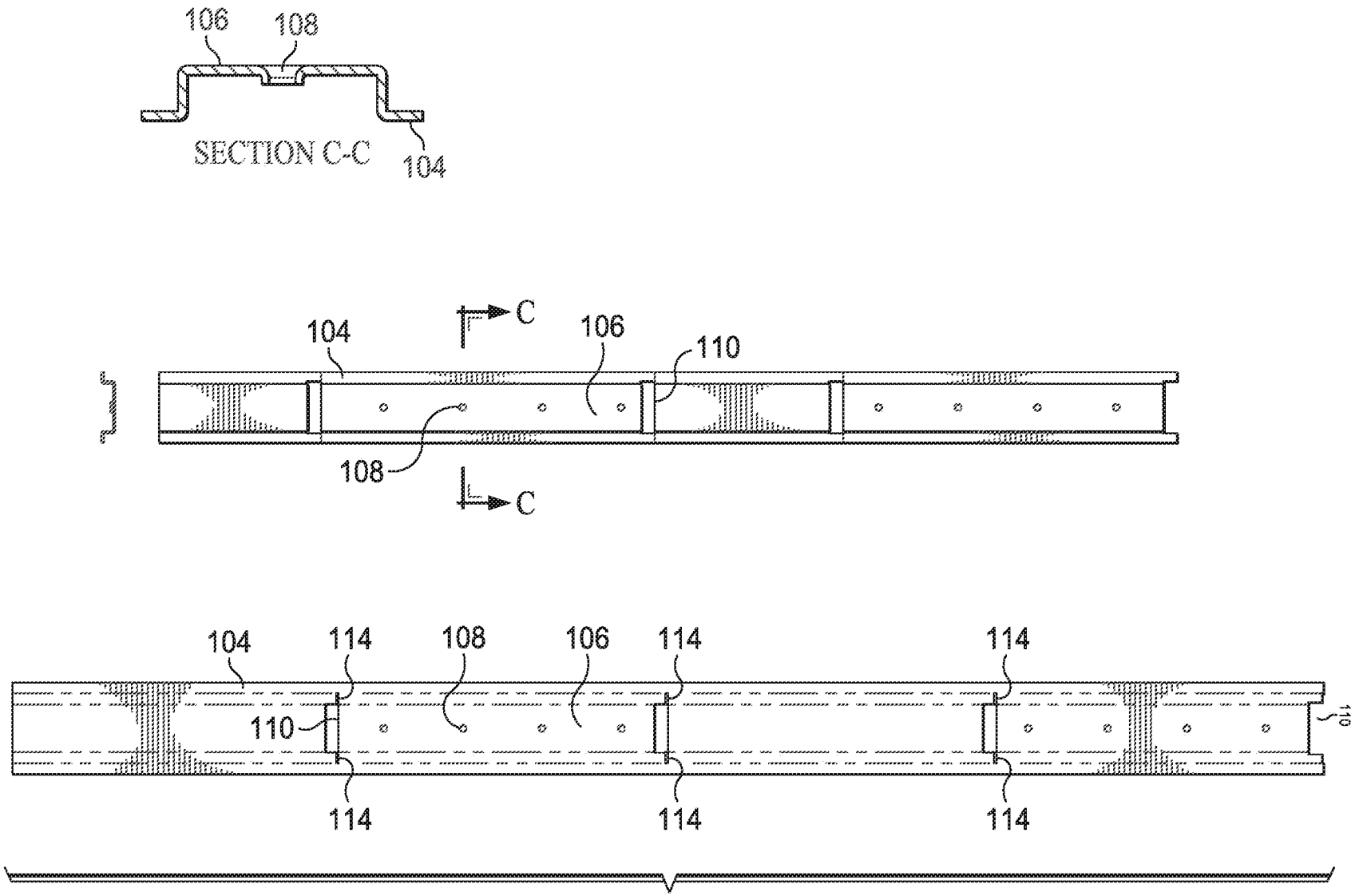
FIG. 2 is a diagram of a roll-formed frame assembly in accordance with an exemplary embodiment of the present disclosure.

FIG. 2 is a diagram of a roll-formed frame assembly in accordance with an exemplary embodiment of the present disclosure. The roll-formed frame is initially flat, as shown in the bottom strip. Tabs 110 are then cut from the strip, such as by laser, flame, water jet, plasma, welding, burning, grinding, drilling, turning, chiseling, shearing, sawing or in other suitable manners, and punched holes 108 are formed in the strip for every second side. Transverse slots 112 are also formed as shown in the upper sides of leg assemblies 104 on either side of tab 110, either by the same process that is used to form tab 110 or by other suitable processes. The strip is then roll-formed to the hat channel, as shown in the upper strip, which includes section view C-C. As shown in section view C-C, legs 104 of the hat channel extend at a right angle to base section 106.

Figure 3:
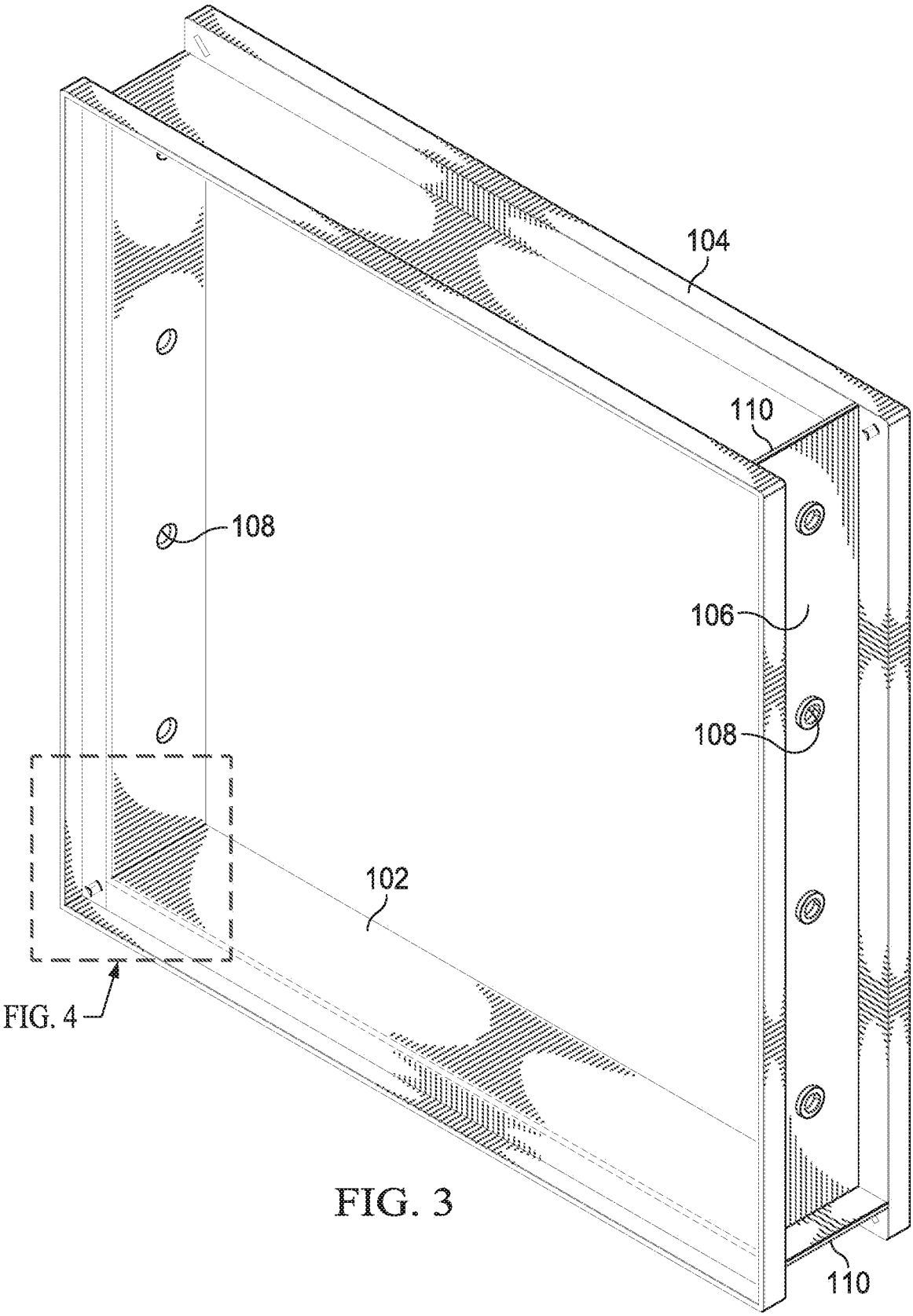
FIG. 3 is a diagram of an isometric view of a single piece roll-formed frame in accordance with an exemplary embodiment of the present disclosure.

FIG. 3 is a diagram of an isometric view of a single piece roll-formed frame in accordance with an exemplary embodiment, of the present disclosure. As shown in the isometric view, the sections of the strip are bent to form right angles at the transverse slots in the upper sides of leg assemblies 104, with tabs 110 extending outward from base section 106 along the upper sides of leg assemblies 104. A rectangular clinch is used to secure the two overlapping sides of leg assemblies 104, which overlap once the roll-formed strip is bent to form the right angles of single piece roll-formed frame 100.

Figure 4:
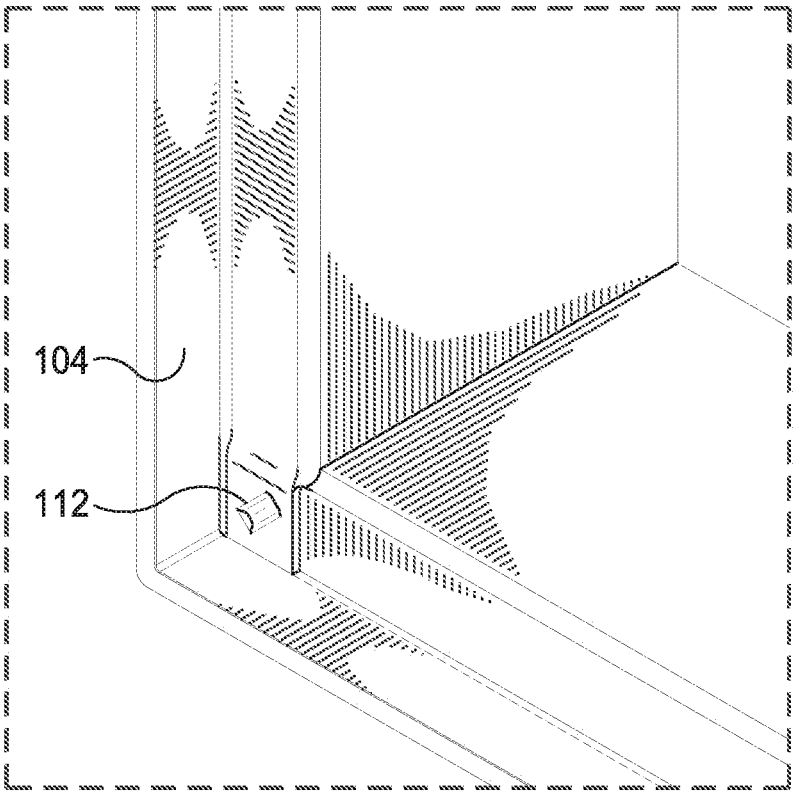
FIG. 4 is a diagram of a corner detail of a single piece roll-formed frame in accordance with an exemplary embodiment of the present disclosure.

FIG. 4 is a diagram of a corner detail of a single piece roll-formed frame in accordance with an exemplary embodiment of the present disclosure. As shown in FIG. 4, rectangular clinch 112 is used to secure the two overlapping upper sides of leg assemblies 104. Although a rectangular clinch 112 is shown, the two overlapping upper sides of adjacent leg assemblies can be connected using welding, riveting, brazing, bolting, fusing, gluing, bonding, epoxying, stapling or other suitable devices, processes or combinations of devices and processes.

The present disclosure thus includes a method for manufacturing a single piece roll-formed frame having a first channel with a base section and one or more legs, where each leg has an upper side extending from the base section at a first angle and a lower side extending from the upper side at a second angle. A second channel has a base section and one or more legs, where each leg has an upper side extending from the base section, at the first angle and a lower side extending from the upper side at the second angle. A third channel has a base section and one or more legs, where each leg has an upper side extending from the base section at the first angle and a lower side extending from the upper side at the second angle. A fourth channel has a base section and one or more legs, where each leg has an upper side extending from the base section at the first angle and a lower side extending from the upper side at the second angle. A plurality of rectangular clinches secures the overlapping upper sides of the legs. A plurality of tabs extends from the base sections of the channels at each intersection of two channels. The base section of the first channel and the base section of the second channel are formed from a single piece and intersect to form a third angle. The upper side of each leg of the first channel overlaps the upper side of each leg of the second channel. The base section of the second channel and the base section of the third channel are formed from the single piece and intersect to form a fourth angle. The upper side of each leg of the second channel overlaps the upper side of each leg of the third channel. The base section of the fourth channel and the base section of the third channel are formed from the single piece and intersect to form a fifth angle. The upper side of each leg of the fourth channel overlaps the upper side of each leg of the third channel. The base section of the fourth channel and the base section of the first channel are formed from the single piece and intersect to form a sixth angle. The upper side of each leg of the fourth channel overlaps the upper side of each leg of the first channel.

The method for manufacturing the single piece roll-formed frame described above includes forming a first tab and at least one adjacent transverse slot in a strip of material. Forming a channel having one or more legs from the sides of the strip of material, each leg having an upper portion and a lower portion, wherein the transverse slot extends into at least the upper portion. Bending the channel at the transverse slot to form a first channel section and a second channel section, wherein the first channel section and the second channel intersect at the tab and the upper portion of the leg of the first channel section overlaps with the upper portion of the leg of the second channel section. Forming a second tab and at least one adjacent transverse slot in the strip of material. Bending the channel at the transverse slot adjacent to the second tab to form a third channel section, wherein the second channel section and the third channel section intersect at the second tab and the upper portion of the leg of the second channel section overlaps with the upper portion of the leg of the third channel section. Forming a third tab and at least one adjacent transverse slot in the strip of material. Bending the channel at the transverse slot adjacent to the third tab to form a fourth channel section, wherein the third channel section and the fourth channel section intersect at the third tab and the upper portion of the leg of the third channel section overlaps with the upper portion of the leg of the fourth channel section. Forming an intersection of the fourth channel section and the first channel section at a fourth tab, where the upper portion of the leg of the fourth channel section overlaps with the upper portion of the leg of the first channel section. Coupling the overlapping the upper portions of each of the legs of the channel sections.

It should be emphasized that the above-described embodiments are merely examples of possible implementations. Many variations and modifications may be made to the above-described embodiments without departing from the principles of the present disclosure. All such modifications and variations are intended to be included herein within the scope of this disclosure and protected by the following claims.

What is claimed is:

1. A single piece roll-formed frame comprising four sides, wherein each side comprises:

a channel comprising a base, a first leg, and a second leg, wherein the base comprises a first edge and a second edge located opposite of one another, wherein the first leg comprises a first inner portion extending from the first edge at a first angle and a first outer portion extending from the first inner portion at a second angle, and wherein the second leg comprises a second inner portion extending from the second edge at a third angle and a second outer portion extending from the second inner portion at a fourth angle; and a tab formed via a first cut in the base spanning between the first edge and the second edge along a first plane that is substantially perpendicular to the base, a second cut across the first inner portion to the first edge of the base and along a second plane that is substantially parallel and not coplanar with the first plane, a third cut along the first edge connecting the second cut with the first cut, a fourth cut across the second inner portion to the second edge of the base and along the second plane that is substantially parallel and not coplanar with the first plane, and a fifth cut on the base along the second edge connecting the fourth cut with the first cut.

2. The single piece roll-formed frame of claim 1, wherein a portion of the tab extends from a first respective base of a first side of the four sides beyond a second respective base of a second side of the four sides.

3. The single piece roll-formed frame of claim 2, wherein the portion of the tab that extends from the first base beyond the second base engages the second base to facilitate a seal.

4. The single piece roll-formed frame of claim 1, wherein a first respective channel of a first side of the four sides is approximately orthogonal to a second respective channel of a second side of the four sides.

5. The single piece roll-formed frame of claim 1, wherein the first angle, second angle, third angle, and fourth angle are each approximately 90 degrees.

6. The single piece roll-formed frame of claim 1, wherein a first respective first inner portion of a first respective first leg of a first side of the four sides and a second respective first inner portion a second respective first leg of a second side of the four sides overlap to form an overlapping section.

7. The single piece roll-formed frame of claim 6, wherein a clinch is configured to secure the first respective first inner portion and the second respective first inner portion together at the overlapping section.

8. The single piece roll-formed frame of claim 1, wherein a respective base of a side of the four sides comprises a plurality of punched holes forming extruded bearing surfaces.

9. The single piece roll-formed frame of claim 1, comprising metal, polymer, or any combination thereof.

10. The single piece roll-formed frame of claim 1, wherein a first length of a first respective base of a first side of the four sides is equal to a second length of a second respective base of a second side of the four sides.

11. A method of forming a single piece roll-formed frame, comprising:

forming a channel, wherein the channel comprises a base, a first leg, and a second leg, wherein the base comprises a first edge and a second edge located opposite of one another, wherein the first leg comprises a first inner portion extending from the first edge at a first angle and a first outer portion extending from the first inner portion at a second angle, and wherein the second leg comprises a second inner portion extending from the second edge at a third angle and a second outer portion extending from the second inner portion at a fourth angle;

making a first cut on the channel spanning between the first edge and the second edge;

making a second cut across the first inner portion to the first edge that is not collinear with the first cut;

making a third cut along the first edge connecting the second cut with the first cut;

making a fourth cut across the second inner portion to the second edge that is substantially collinear with the second cut and not collinear with the first cut;

making a fifth cut along the second edge connecting the fourth cut with the first cut; and bending the channel along a first line collinear with the second cut and the fourth cut to form a first channel section and a second channel section.

12. The method of claim 11, wherein the first angle, second angle, third angle, and fourth angle are each 90 degrees.

13. The method of claim 11, comprising positioning the second cut such that it is approximately orthogonal with respect to the first inner portion and the first edge and positioning the fourth cut such that it is approximately orthogonal with respect to the second inner portion and the second edge.

14. The method of claim 11, wherein bending the channel along the first line comprises overlapping a first respective first inner portion of the first channel section with a second respective first inner portion of the second channel section at the second cut and the fourth cut.

15. The method of claim 14, comprising securing the first respective first inner portion of the first channel with the second respective first inner portion of the second channel via clinching, welding, riveting, brazing, bolting, fusing, gluing, bonding, epoxying, stapling, or any combination thereof.

16. The method of claim 11, comprising forming a tab via the first, second, third, fourth, and fifth cuts via laser, flame, water jet, plasma, welding, burning, grinding, drilling, turning, chiseling, shearing, sawing, or any combination thereof.

17. The method of claim 11, comprising cutting holes in the base via drilling, etching, burning or any combination thereof.

18. The method of claim 11, comprising:

making a sixth cut on the channel spanning from the first edge to the second edge;

making a seventh cut across the first inner portion to the first edge that is not collinear with the sixth cut;

making an eighth cut along the first edge connecting the seventh cut with the sixth cut;

making a ninth cut across the second inner portion to the second edge that is substantially collinear with the seventh cut and not collinear with the sixth cut;

making a tenth cut on the base along the second edge connecting the ninth cut with the sixth cut; and bending the channel along a second line collinear with the seventh cut and the ninth cut to form a third channel section.

19. The method of claim 18, wherein bending the channel along the second line comprises overlapping a third respective first inner portion of the second channel section with a fourth respective first inner portion of the third channel section at the seventh cut and the ninth cut.

20. A single piece roll-formed frame comprising four sides, wherein each side comprises:

a channel comprising a base, a first leg, and a second leg, wherein the base comprises a first edge and a second edge located opposite of one another, wherein the first leg comprises a first inner portion extending from the first edge at a first angle and a first outer portion extending from the first inner portion at a second angle, and wherein the second leg comprises a second inner portion extending from the second edge at a third angle and a second outer portion extending from the second inner portion at a fourth angle; and a tab formed via a first cut in the base spanning between the first edge and the second edge, a second cut across the first inner portion to the first edge of the base that is not collinear with the first cut, a third cut along the first edge connecting the second cut with the first cut, a fourth cut across the second inner portion to the second edge of the base that is not collinear with the first cut, and a fifth cut on the base along the second edge connecting the fourth cut with the first cut, wherein a first respective first inner portion of a first respective first leg of a first side of the four sides and a second respective first inner portion of a second respective first leg of a second side of the four sides overlap to form an overlapping section.

21. The single piece roll-formed frame of claim 20, wherein a first length of a first respective base of a first side of the four sides is equal to a second length of a second respective base of a second side of the four sides.

* * * * *